US012018345B2

(12) United States Patent
Saratovsky et al.

(10) Patent No.: US 12,018,345 B2
(45) Date of Patent: Jun. 25, 2024

(54) PYRO-METALLURGICAL PROCESS IN A ROTARY KILN

(71) Applicant: S.A. Lhoist Recherche et Developpement, Ottignies-Louvaln-la-Neuve (BE)

(72) Inventors: Ian Saratovsky, Highland Park, IL (US); Wliiiam Edward Johnson, Jr., Birmingham, AL (US)

(73) Assignee: S.A. LHOIST RECHERCHE ET DEVELOPPEMENT, Ottignies-Louvain-la-Neuve (BE)

( * ) Notice: Subject to any disclaimer, the term of this patent is extended or adjusted under 35 U.S.C. 154(b) by 0 days.

(21) Appl. No.: 17/539,728

(22) Filed: Dec. 1, 2021

(65) Prior Publication Data

US 2022/0178001 A1 Jun. 9, 2022

Related U.S. Application Data

(60) Provisional application No. 63/199,137, filed on Dec. 9, 2020.

(30) Foreign Application Priority Data

Jan. 19, 2021 (EP) ..... 21152215

(51) Int. Cl.
*C22B 19/28* (2006.01)
*C22B 19/38* (2006.01)

(52) U.S. Cl.
CPC ..... *C22B 19/28* (2013.01); *C22B 19/38* (2013.01)

(58) Field of Classification Search
CPC ..... C22B 19/28; C22B 19/38; C22B 11/023; C22B 13/025; C22B 15/0026;
(Continued)

(56) References Cited

U.S. PATENT DOCUMENTS

2011/0042868 A1 2/2011 Van Camp et al.

FOREIGN PATENT DOCUMENTS

WO 9836102 A1 8/1998

OTHER PUBLICATIONS

Ebbenis and Carlson, Ring Formation in Rotary Kilns, Feeco International (2022) (Year: 2022).*

(Continued)

*Primary Examiner* — Brian D Walck
*Assistant Examiner* — Danielle M. Carda
(74) *Attorney, Agent, or Firm* — Whitaker Chalk Swindle & Schwartz, PLLC; Charles D. Gunter, Jr.

(57) ABSTRACT

A pyro-metallurgical process for producing a non-ferrous metal or a compound thereof, wherein a metal raw material is fed into a rotary kiln, the metal being one of arsenic (As), antimony (Sb), lead (Pb), cadmium (Cd), mercury (Hg), silver (Ag), tin (Sn), nickel (Ni), or zinc (Zn). The raw material is heated to produce a volatized material, in which the non-ferrous metal or compound thereof is produced from the volatized material. A magnesium-based additive is additionally fed to the rotary kiln in an amount of between 0.5 wt. % and 9.5 wt. % relative to the total weight of the raw material. The magnesium-based additive is heated together with the raw material to produce the volatized material and a solid product while also counteracting ring formation in the rotary kiln.

14 Claims, 3 Drawing Sheets

(58) Field of Classification Search
CPC ..... C22B 19/30; C22B 30/02; C22B 30/04; C22B 43/00; C22B 17/02; C22B 23/02; C22B 25/02; C22B 7/02; Y02P 10/20; C21C 2200/00
USPC ..... 75/745
See application file for complete search history.

(56) References Cited

OTHER PUBLICATIONS

Nakayama, Michio, EAF Dust Treatment for High Metal Recovery, (Mar. 23, 2019) (Year: 2019).*
Ispat Guru, Dolomite—A Useful Mineral, Ispat Digest (Jun. 28, 2017) (Year: 2017).*
Zincore Metals Inc. Zincore Progresses on Optimizing Metallurgical Process for Accha Zinc Oxide District Project, Marketwire, Dec. 17, 2012 (Year: 2012).*
Popovici, Vlad By-Products from EAF Dust RecycIng and Their Valorisation, 5th Global Slag Conference, Brussels Nov. 23-24, 2009 (Year: 2009).*

* cited by examiner

PYRO-METALLURGICAL PROCESS IN A ROTARY KILN

FIELD OF THE INVENTION

The present invention relates to a pyro-metallurgical process in a rotary kiln, in particular a Waelz process, for producing at least one non-ferrous metal or a compound thereof, wherein said metal is selected from the group consisting of arsenic (As), antimony (Sb), lead (Pb), cadmium (Cd), mercury (Hg), silver (Ag), tin (Sn), Nickel (Ni), and zinc (Zn).

BACKGROUND OF THE INVENTION

Production of non-ferrous metal by extraction and purification from raw materials such as ores and slags are carried out via a large variety of processes. Among them, pyro-metallurgical processes involve heating such raw materials, typically in a rotary kiln, allowing physical and chemical transformations of the raw materials and the recovery of the compounds of interest.

Typically, a rotary kiln has a cylindrical shape, the length of the cylinder being much greater than its width. The kiln rotates around a rotation axis which is inclined allowing the raw materials to be pyro-processed in the kiln to travel downwards through the kiln under the effect of gravity. The kiln comprises a burner assembly at its lower end for the combustion of fuel so as to generate the heat necessary for pyro-processing. The flue gases, along with any volatile compounds are generated in the kiln and then evacuated from the kiln at its upper end.

It is well known that pyro-metallurgical processes in rotary kilns are prone to build-ups and accumulation of particles on the inner wall of the rotary kiln, thereby forming "rings" of accumulated particles (thereafter "kiln rings").

Such kiln rings can drastically limit the production capacity of the kiln and lead to tedious cleaning operation where the production process has to be shutdown. Kiln rings hold up materials from moving down the rotary kiln in normal conditions, by reducing the cross area of the rotary kiln. Furthermore, the accumulation of particles on the inner wall of the rotary kiln lowers heat transfer. Periodic shutdown operations to clean and/or to remove kiln rings result in lost production time (four days downtime every thirty days of run time is common).

Various methods have been proposed to prevent the formation or the disposing of kiln rings during pyro-metallurgical processes.

Current tools for on-line cleaning, without requiring the shutdown of the process, involve shotgun blasting and/or thermal shedding. In shotgun blasting, large gauge shotgun shells are shot at the kiln ring in an effort to destabilize and "knock down" the ring. The drawbacks to shotgun blasting is that it is rarely effective in destabilizing the entire ring structure, resulting in only small chunks of kiln ring detaching form the leading edges. Additionally, shotgun blasting can result in damage to refractory walls of the rotary kiln and results in kiln hot spot and ultimately damage to the kiln itself.

Another solution for removing the kiln ring is the thermal shedding which consists in a rapid decrease of the temperature of the kiln. This temperature reduction results in contraction of the ring and cause the ring to detach from the inner walls of the kiln. The drawbacks of thermal shedding are that rapid cooling and resultant contraction can result in damage to refractory brick and the rotary kiln itself. After cycles of rapid cooling and heating, the centricity of the kiln can degrade, thereby decreasing the performance of the rotary kiln over time.

Other methods consist in preventing the formation of kiln ring onto the inner wall of said rotary kiln.

U.S. Pat. No. 4,525,208 describes a continuous method of recovering Zn and Pb from iron and steel dust with the aim to improve the ratio of volatilization of Zn and Pb to a great extent and to preclude the formation of deposits on the rotary kiln wall. This continuous method comprises notably adding a fluxing agent, which is optionally limestone or quick lime, which has an effect of lowering the melting point of the charge under treatment and possibly reduces formation of deposits on the inner wall surface of the rotary kiln. This was exemplified by, for example, feeding a rotary kiln with notably iron and steel dust and limestone.

JP 2013159797 describes a method for producing reduced iron and zinc in a rotary kiln in which for example steel is used as a raw material. The rotary kiln is operating continuously for a long period of time. In order to suppress the generation of deposits on the inner wall of the kiln, a CaO source is added to the steel dust so as to set the $CaO/SiO_2$ ratio higher than 1.5. Furthermore, the particle size of the added CaO source is adjusted so that at least 80% of the particles present a size of 0.2 mm.

CN 105039700 B also discloses a reduction volatilization method for the recovery of Zn and Pb with the aim to improve the volatilization rate of Pb and Zn. Use is made of hydrometallurgical zinc slags as starting materials. In this method a slag abatement agent is added to a mixture of this hydrometallurgical zinc smelting slag and a reducing agent such as coal powder in an amount between 10 and 50 wt. % relative to the weight of zinc slag and coal powder. In the working examples, a large variety of slag abatement agents are used including lime, magnesium oxide, alumina, limestone, dolomite, bauxite and mixtures thereof. Due to the high amounts of the slag abatement agent being used, the formation of the kiln ring is avoided. However, adding such a high amount of slag abatement agent also results in greater amount of wastes and impurities in by-products of such process. Typically, by-products resulting from pyro-metallurgical process may be valorized and used in a variety of applications, such as road-based/civil construction materials. However, such by-products need to satisfy certain standard requirements in terms of the content of impurities to comply with such requirements. Furthermore, in this method use is made of high amounts of reducing agent (e.g. 50 wt. % of coal based on the weight of zinc slags).

In view of the above, there is a strong need for an improved pyro-metallurgical process in a rotary kiln, which counteracts the formation of kiln rings in the rotary kiln, and in which the amount of wastes such as impurities, which need to be treated to comply with environmental requirements, is reduced, thereby allowing a by-product to be valorized without the need of extensive purification processes.

SUMMARY OF THE INVENTION

The inventors have now surprisingly found that it is possible to provide an improved pyro-metallurgical process for producing at least one non-ferrous metal or a compound thereof, wherein said metal is selected from the group consisting of arsenic (As), antimony (Sb), lead (Pb), cadmium (Cd), mercury (Hg), silver (Ag), tin (Sn), nickel (Ni), and zinc (Zn) overcoming the above mentioned disadvantages.

It is thus an object of the present invention to provide a pyro-metallurgical process, in particular a Waelz process, for producing at least one non-ferrous metal or a compound thereof, wherein said metal is selected from the group consisting of arsenic (As), antimony (Sb), lead (Pb), cadmium (Cd), mercury (Hg), silver (Ag), tin (Sn), nickel (Ni), and zinc (Zn), and wherein at least one raw material is fed into a rotary kiln, wherein said at least one raw material comprises at least said metal, and wherein said raw material is heated to produce a volatized material, in which the non-ferrous metal or compound thereof is produced from the volatized material, in which process a magnesium-based additive, is additionally fed in the rotary kiln in an amount of between 0.5 wt. % and 9.5 wt. % relative to the total weight of said raw materials, which magnesium-based additive is heated together with said raw material to produce at least the volatized material and a solid product, thereby counteracting ring formation in the rotary kiln.

BRIEF DESCRIPTION OF THE DRAWINGS

FIGS. 2.B, 2.C are SEM-EDS images of a kiln ring sample according to a counter-example, wherein the Mg composition (FIG. 1.B) and Ca composition (FIG. 1.C) are highlighted with EDS measurements.

FIG. 2.D is a SEM image of a kiln ring sample according to the example according to the present invention.

FIGS. 2.E and 2.F are SEM-EDS images of a kiln ring sample according to the example of the present invention, wherein the Mg composition (FIG. 2.E) and Ca composition (FIG. 2.F) are highlighted with EDS measurements.

FIG. 3.B is elemental map of a kiln ring sample according to the example of the present invention, in which the presence of FeO, ZnO, $SiO_2$, MgO, and CaO have been mapped using SEM-EDS technique.

DETAILED DESCRIPTION OF THE INVENTION

Figure 1:
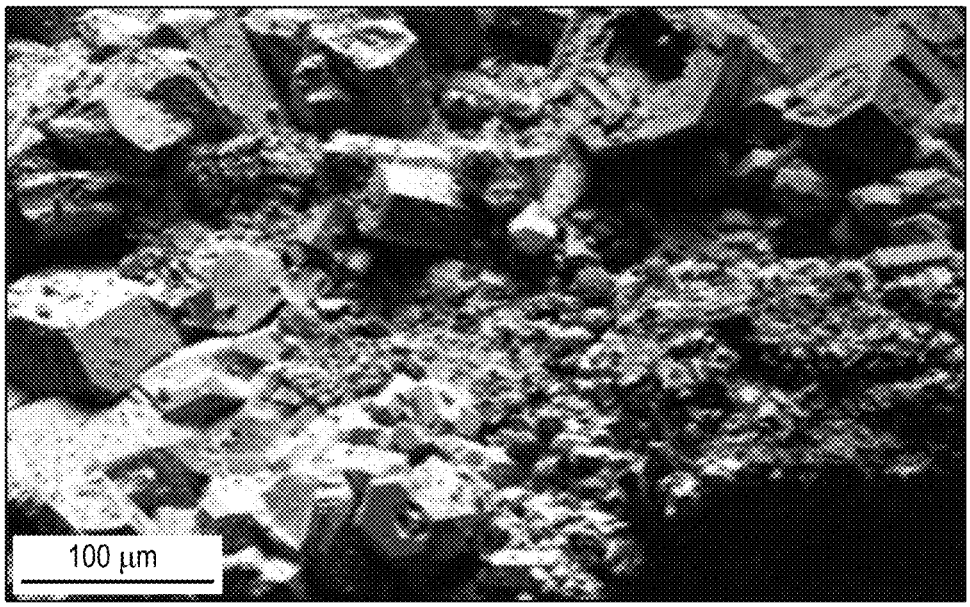
FIG. 1 and FIG. 2.A are SEM images of a kiln ring sample according to a counter-example.

Within the context of the present invention, the term "comprising" should not be interpreted as being restricted to the means listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a composition comprising components A and B" should not be limited to compositions consisting only of components A and B. It means that with respect to the present invention, the only relevant components of the composition are A and B. Accordingly, the terms "comprising" and "including" encompass the more restrictive terms "consisting essentially of" and "consisting of".

Within the context of the present invention, the expressions "at least one non-ferrous metal or a compound thereof", and "at least one raw material", are intended to denote one or more than one non-ferrous metal or a compound thereof, and one or more than one raw material, respectively. Mixtures of non-ferrous metals or compounds thereof, and mixtures of raw materials may be used, respectively.

In the rest of the text, the expressions "non-ferrous metal or compound thereof" and "raw material" are understood, for the purposes of the present invention, both in the plural and the singular form.

Within the context of the present invention, the term "counteract the formation of ring" is intended to denote the action of reducing the accumulation of particles forming a kiln ring and/or avoiding the build-up of said kiln ring.

The inventors have surprisingly found that by additionally feeding a magnesium-based additive in the rotary kiln in only an amount of between 0.5 wt. % and 9.5 wt. % relative to the total weight of said raw materials, ring formation in the rotary kiln is counteracted, and leads the ring to shed under its own weight, without external forces other than the forces engaged by the rotary kiln. This results in reducing the periodic shutdown operations, as illustrated in the working examples below. Furthermore, the inventors have surprisingly found that such rings are more susceptible to on-line cleaning such as thermal shedding or shotgun blasting. Without being bound to this theory, the inventors consider that the additional feeding of a magnesium-based additive in an amount of between 0.5 wt. % and 9.5 wt. % relative to the total weight of said raw materials might affect the ring's microscopic structure, which results, in addition to an increase the melting point of the fed materials within the rotary kiln, to weaken the cohesive strength of the kiln ring.

As said, the amount of the magnesium-based additive which is additionally fed in the rotary kiln with the raw materials is of between 0.5 wt. % and 9.5 wt. %, relative to the total weight of the raw materials. This also allows to keep the total amount of solid product as low as possible and also the total amount of impurities therein. This results in reducing the amount of waste and this solid product may be used and valorized in various applications without requiring the need of extensive purification processes.

In an embodiment of the process of the present invention, the magnesium-based additive is fed in the rotary kiln in an amount of at most 9.0 wt. %, or at most 8.5 wt. %, or at most 8.0 wt. %, or at most 7.5 wt. %, relative to the total weight of the raw materials.

It is further understood that in the process of the present invention, the magnesium-based additive is advantageously fed in the rotary kiln in an amount of at least 0.8 wt. %, or at least 1.0 wt. %, or at least 1.5 wt. %, or at least 2.0 wt. %, or at least 2.5 wt. %, or at least 3.0 wt. %, relative to the total weight of the raw materials.

In a preferred embodiment of the process of the present invention, the magnesium-based additive is advantageously fed in the rotary kiln in an amount ranging from 0.8 wt. % to 9.0 wt. %, or from 1.0 wt. % to 8.5 wt. %, or from 1.5 wt. % to 8.0 wt. %, or from 2.0 wt. % to 7.5 wt. %, or from 2.5 wt. % to 7.5 wt. % relative to the total weight of the raw materials.

Good results were found when the magnesium-based additive is fed in the rotary kiln in an amount of between 3.0 wt. % and 7.5 wt. %, relative to the total weight of the raw materials.

In the context of the present invention, any magnesium-based additive which is capable, of providing magnesium oxide in low amounts in the solid product, as detailed above, when said magnesium-based additive is fed and heated in the rotary kiln, may be used.

Within the context of the present invention, the expression "magnesium-based additive" is intended to refer to a compound comprising at least one magnesium salt or a composition comprising at least one magnesium salt or a mixture thereof.

Within the context of the present invention, the expression "at least one magnesium salt" is intended to denote one or more than one magnesium salt.

In the rest of the text, the expression "at least one magnesium salt" is understood, for the purposes of the present invention, both in the plural and the singular.

Non-limiting examples of suitable magnesium salts mention may be made of magnesium carbonate, magnesium hydroxide, magnesium oxide, magnesium sulfate, or magnesium nitrate.

According to a preferred embodiment of the process of the present invention, the at least one magnesium salt is selected from the group consisting of magnesium carbonate, magnesium oxide, and magnesium hydroxide.

According to a preferred embodiment of the process of the present invention, the magnesium-based additive can further comprise at least one calcium salt selected from the group consisting of calcium carbonate, calcium oxide, and calcium hydroxide.

According to a preferred embodiment of the process of the present invention, the magnesium-based additive is a compound comprising or consisting essentially of the magnesium salt, as detailed above and the calcium salt, as detailed above, wherein the total amount of the magnesium salt and the calcium salt is more than 80.0 wt. %, or more than 85.0 wt. % or more than 90.0 wt. % or more than 95.0 wt. % or desirably more than 98.0 wt. % relative to the total weight of the compound, and wherein the magnesium salt content is of at least 10.0 wt. %, or of at least 15.0 wt. %, or of at least 20.0 wt. %, or of at least 25.0 wt. %, or desirably of at least 30.0 wt. %, relative to the total weight of the magnesium salt and the calcium salt. Advantageously, the magnesium salt content is less than 90.0 wt. %, or less than 80.0 wt. %, or less than 70.0 wt. %, or less than 60.0 wt. %, or less than 55.0 wt. %, or less than 50.0 wt. %, or desirably less than 45.0 wt. %, relative to the total weight of the magnesium salt and the calcium salt.

Desirably, the magnesium salt content, varies from 10.0 wt. % to 90.0 wt. %, or from 15.0 wt. % to 80.0 wt. %, or from 20.0 wt. % to 70.0 wt. %, or from 25.0 wt. % to 60.0 wt. % or from 30.0 wt. % to 50.0 wt. %, or from 30.0 wt. % to 45.0 wt. %, relative to the total weight of the magnesium salt and the calcium salt.

Said magnesium-based compounds may be synthetically prepared by a variety of methods known in the art or can be of natural origin.

Non-limiting examples of magnesium-based compounds of natural origin mention may be made of mined (raw) minerals such as dolomite and dolomitic limestones.

In general, dolomitic limestone comprises $MgCO_3$ and $CaCO_3$, in which the $MgCO_3$ and $CaCO_3$ are present in a total amount of more than 95.0 wt. %, or more than 96.0 wt. %, or more than 97.0 wt. %, or desirably more than 98.0 wt. %, relative to the total weight of the dolomitic limestone, and wherein the $MgCO_3$ content may vary from 20.0 wt. % to 45.0 wt. %, or from 25.0 wt. % to 40.0 wt. %, or from 30.0 wt. % to 40.0 wt. % relative to the total weight of $MgCO_3$ and $CaCO_3$.

In general, dolomite comprises $MgCO_3$ and $CaCO_3$, in which the $MgCO_3$ and $CaCO_3$ are present in a total amount of more than 95.0 wt. %, or more than 96.0 wt. %, or more than 97.0 wt. %, or desirably more than 98.0 wt. %, relative to the total weight of the dolomitic limestone, and wherein the $MgCO_3$ and $CaCO_3$ content are present in a 1:1 molar ratio.

Non-limiting examples of synthetically prepared magnesium-based compounds suitable to be used in the process of the present invention may be partly or fully burnt dolomite consisting of calcium oxide and magnesium oxide (also called calcined dolomite or dolomitic quick lime or dolime), calcium hydroxide and magnesium oxide (also called semi-hydrated dolomitic lime) or calcium hydroxide and magnesium hydroxide (also called type S hydrated lime).

Alternatively, the magnesium-based additive can be a composition comprising the at least one magnesium salt, as detailed above and at least one calcium salt selected from the group consisting of calcium carbonate, calcium oxide, and calcium hydroxide.

According to this embodiment of the process of the present invention, the magnesium-based additive can also be a compound comprising the at least one magnesium salt, as detailed above and at least one calcium salt selected from the group consisting of calcium carbonate, calcium oxide, and calcium hydroxide.

Within the context of the present invention, the expression "at least one calcium salt" is intended to denote one or more than one calcium salt.

In the rest of the text, the expression "at least one calcium salt" is understood, for the purposes of the present invention, both in the plural and the singular.

According to one embodiment of the process of the present invention, the magnesium-based additive is a composition comprising or consisting essentially of the magnesium salt, as detailed above and the calcium salt, as detailed above, wherein the total amount of the magnesium salt and the calcium salt is more than 80.0 wt. %, or more than 85.0 wt. % or more than 90.0 wt. % or more than 95.0 wt. % or more than 98.0 wt. %, relative to the total weight of the composition, and wherein the magnesium salt content is of at least 10.0 wt. %, or of at least 15.0 wt. %, or of at least 20.0 wt. %, or of at least 25.0 wt. %, or desirably of at least 30 wt. % relative to the total weight of the magnesium salt and the calcium salt. Advantageously, the magnesium salt content is less than 90.0 wt. %, or less than 80.0 wt. %, or less than 70.0 wt. %, or less than 60.0 wt. %, or less than 55.0 wt. %, or less than 50.0 wt. %, or less than 45.0 wt. %, relative to the total weight of the magnesium salt and the calcium salt.

Desirably, the magnesium salt content, varies from 10.0 wt. % to 90.0 wt. %, or from 15.0 wt. % to 80.0 wt. %, or from 20.0 wt. % to 70.0 wt. %, or from 25.0 wt. % to 60.0 wt. % or 30.0 wt. % to 50.0 wt. % relative to the total weight of the magnesium salt and the calcium salt.

Said magnesium-based compositions may be prepared by a variety of methods known in the art.

Alternatively, the magnesium-based additive consists essentially of at least one magnesium salt, as detailed above.

Within the context of the present invention, the term "consisting essentially of" is to be understood to mean that any additional component different from the magnesium salt, as detailed above, is present in an amount of at most 1.0 wt. %, or at most 0.5 wt. %, or at most 0.1 wt. %, based on the total weight of the magnesium-based additive.

Any order of feeding the magnesium-based additive, as detailed above and the raw materials into the rotary kiln can be used.

When appropriate, the magnesium-based additive, as detailed above and the raw materials can be pre-mixed prior to feeding into the rotary kiln, or the magnesium-based additive and the raw material can be separately fed into the rotary kiln.

When the magnesium-based additive and the raw materials are separately fed into the rotary kiln, the magnesium-based additive and the raw materials can be fed simultaneously, or, if desired, the magnesium-based additive can be fed after the raw material is fed, or, if desired, the raw material can be fed after the magnesium-based additive is fed. Furthermore, if desired, the magnesium-based additive and the raw material can be fed at the same entry point of the rotary kiln, or at different entry point of the rotary kiln.

According to a preferred embodiment of the process of the present invention, the magnesium compound was fed on a belt conveyor onto the EAF dust feed.

As said above, the at least one raw material comprises the at least one non-ferrous metal selected from the group consisting of arsenic (As), antimony (Sb), lead (Pb), cadmium (Cd), mercury (Hg), silver (Ag), tin (Sn), nickel (Ni), and zinc (Zn), or a compound thereof.

Suitable raw materials that may be used in the pyro-metallurgical process, in particular in the Waelz process of the present invention, mention may be made of fresh ores, also called primary sources, or recyclable materials, also known as secondary feedstocks, or a combination thereof. Recyclable materials may for instance be by-products waste materials of the iron or steel industry such as notably dusts and muds obtained from blast furnace plants, sintering plants, steel making, rolling mill plants, or electric arc furnaces and end-of-life materials. For example, electric arc furnace (EAF) dust is a byproduct waste generated by the secondary steelmaking process in an electric arc furnace. Such EAF dust may contain the element zinc in amounts varying between 7.0 and 40.0 wt. %, depending on the scrap used, and the ratio of galvanized scrap utilized. Dust and powders collected in the de-dusting systems from the electric arc furnace (EAF) is primarily composed by iron and zinc, in which zinc is generally found in its metallic form, zinc oxide and zinc ferrite, followed by lead, copper, nickel, calcium and magnesium oxides.

According to a preferred embodiment of the process of the present invention, the raw material is an electric arc furnace (EAF) dust comprising zinc and compounds thereof in an amount between 7.0 wt. % and 40.0 wt. %, or of between 12.0 wt. % and 40.0 wt. %, or of between 15.0 wt. % and 30.0 wt. %, or of between 15.0 wt. % and 25.0 wt. %; as expressed in zinc oxide wt. % relative to the weight of the raw material.

In general, in pyro-metallurgical processes, in particular in Waelz processes, the inner temperature of the rotary kiln is adjusted to an appropriate temperature in order to assure the formation of volatized materials.

According to an embodiment of the process of the present invention, the raw material is heated to produce the volatized material at a temperature of at least 900° C., or at least 1100° C., desirably at least 1200° C. It is further understood that the raw material is advantageously heated to produce the volatized material at a temperature of the order of about 1400° C.

At these heating temperatures, as detailed above, the volatile non-ferrous metals selected from the group consisting of arsenic (As), antimony (Sb), lead (Pb), cadmium (Cd), mercury (Hg), silver (Ag), tin (Sn), nickel (Ni), and zinc (Zn), in particular in metallic form, may volatize and leave the rotary kiln with the exhaust gases, whereas other components remain in solid phase. Especially in Waelz processes, the volatilization of non-ferrous metals such as notably zinc, lead and cadmium, from the raw material, in particular from EAF dust, is realized in the presence of a reducing agent.

At these heating temperatures, as detailed above, there is enough energy provided to reduce at least partially the raw material in the presence of a reducing agent to produce a volatized material in which the non-ferrous metal or compound thereof, thereby avoiding damaging the rotary kiln.

According to an embodiment of the process of the present invention, at least one reducing agent is additionally fed in the rotary kiln.

Within the context of the present invention, the expression "at least one reducing agent" is intended to denote one or more than one reducing agent.

In the rest of the text, the expression "at least one reducing agent" is understood, for the purposes of the present invention, both in the plural and the singular, that is to say in the process of the present invention may comprise feeding in the rotary kiln one or more than one reducing agent.

Non-limiting examples of suitable reducing agents that may be used in the pyro-metallurgical process, in particular in the Waelz process of the present invention, mention may be made of carbonaceous materials, such as notably coal, coke or anthracite, desirably coal or coke are used as reducing agents.

It is further understood that any coal or coke known to the skilled in the art may be used.

In a preferred embodiment of the process of the present invention, the reducing agent is fed into the rotary kiln in an amount of at most 40.0 wt. %, or of at most 30.0 wt. %, or of at most 25.0 wt. % relative to the total weight of said at least one raw material.

As a general rule, the reducing agent is present in a minimum amount sufficient to have optimized reduction of the raw materials. Desirably, the reducing agent is fed into the rotary kiln in an amount of at least 5.0 wt. %, or of at least 7.5 wt. %, or of at least 10 wt. %, relative to the total weight of said at least one raw material.

In a preferred embodiment of the process of the present invention, the reducing agent is fed into the rotary kiln in an amount of between 5.0 and 40.0 wt. %, or of between 7.5 and 30.0 wt. %, or of between 10.0 and 25.0 wt. % relative to the total weight of said at least one raw material.

Any order of feeding the reducing agent, as detailed above, the magnesium-based additive, as detailed above and the raw material, as detailed above, into the rotary kiln can be used.

When appropriate, the raw material and the reducing agent can be pre-mixed prior to feeding into the rotary kiln, or the magnesium-based additive and the reducing agent can be pre-mixed prior to feeding into the rotary kiln, or the reducing agent, the magnesium-based additive, and the raw material can be pre-mixed prior to feeding into the rotary kiln, or the reducing agent, the magnesium-based additive, and the raw material can all be separately fed into the rotary kiln.

When the raw material and the reducing agent are pre-mixed prior to feeding into the rotary kiln, said raw material and reducing agent may be compacted into pellets.

When separately fed into the rotary kiln, the feeding can still occur simultaneously or consecutively, and furthermore at the same entry point of the rotary kiln, or at different entry points of the rotary kiln.

The inventors have found that by additionally feeding said magnesium-based additive in the rotary kiln in an amount of between 0.5 wt. % and 9.5 wt. % relative to the total weight of said raw materials, as described above, allows to provide between 0.03 wt. % and 5.00 wt. %, or of between 0.50 wt. % and 4.5 wt. %, or of between 1.0 wt. % and 4.00 wt. %, or of between 1.0 wt. % and 3.50 wt. %, or of between 1.0 wt. % and 3.00 wt. %, or of between 1.0 wt. % and 3.10 wt. %, or of between 1.0 wt. % and 2.90 wt. %, or of between 1.0 wt. % and 2.70 wt. %, or of between 1.0 wt. % and 2.30 wt. %, or of between 1.0 wt. % and 2.20 wt. %, or of between 1.0 wt. % and 2.00 wt. % or of between 1.0 wt. % and 1.80 wt. % of magnesium oxide in the solid product.

Due to the presence of only small amounts of magnesium oxide in the solid product, the solid product is more suitable to be used for road-based constructions. In particular, in the Waelz process, the solid product, is also called Waelz Iron Product (WIP), and is found especially suitable to be used for road-based constructions.

According to a preferred embodiment of the process of the present invention, the pyro-metallurgical process is a Waelz process.

According to a preferred embodiment of the process of the present invention, the pyro-metallurgical is a Waelz process for the production of non-ferrous metal or a compound thereof, chosen from the group consisting of zinc and lead and cadmium.

According to a preferred embodiment of the process of the present invention, the pyro-metallurgical process is a Waelz process, wherein the raw material is an EAF dust.

The composition of such EAF dust may vary widely due to different composition of the starting materials used in the electric arc furnace. In general, such EAF dusts may comprise zinc and zinc compounds (i.e. zinc oxides) in an amount, varying from 7.0 to 40.0 wt. %, as expressed in zinc oxide wt. % relative to the weight of the raw material, and iron oxide in an amount varying from 20.0 to 50.0 wt. %, relative to the weight of the raw material. An example of the composition of such EAF dust as raw material for a Waelz process is notably described in Process Safety and Environmental Protection, 129 (2019), 308-320, incorporated herein by reference.

According to a preferred embodiment of the process of the present invention, the pyro-metallurgical process is a Waelz process, wherein the raw material is an EAF dust comprising zinc and compounds thereof in an amount of at least 7.0 wt. %, at least 10.0 wt. %, or of at least 12.0 wt. %, or of at least 15.0 wt. %, as expressed in zinc oxide wt. % relative to the weight of the EAF dust.

It is further understood that said EAF dust comprises advantageously zinc and compounds thereof in an amount of at most 40.0 wt. %, or of at most 30.0 wt. %, or of at most 25.0 wt. %, as expressed in zinc oxide wt. % relative to the weight of the EAF dust. as expressed in zinc oxide wt. %

According to a preferred embodiment of the process of the present invention, the raw material is an electric arc furnace (EAF) dust comprising zinc and compounds thereof in an amount between 7.0 wt. % and 40.0 wt. %, or of between 12.0 wt. % and 40.0 wt. %, or of between 15.0 wt. % and 30.0 wt. %, or of between 15.0 wt. % and 25.0 wt. %; as expressed in zinc wt. %, relative to the weight of the EAF dust.

Typically, in the Waelz process, the volatized materials escapes the rotary kiln from its upper end and are collected in a collection area, such as for example a bag filter or an electrostatic precipitator, and obtained as a fine dust. In general, zinc oxide is recovered by the oxidation of volatized zinc into solid zinc oxide. The so-called Waelz oxide thereby obtained may be later taken to refineries for recovering the metallic zinc. Furthermore, the solid product, also called Waelz Iron Product, or WIP, is also recovered as by-product of the Waelz process from the bottom end of the rotary kiln.

Such WIP may be used as raw materials for use in the field of road construction, in the production of cement, of concrete, bricks, for sportsgrounds and dykes, or drainage layer for landfills.

It is further understood that all the definitions, preferences and preferred embodiments hereinabove, also apply for all further embodiments, as described below.

Another aspect of the present invention is the use of the solid product produced by the process of the present invention in the field of road construction, in the production of cement, of concrete, bricks, for sportsgrounds and dykes, or drainage layer for landfills.

Another aspect of the present invention is a pyro-metallurgical process, in particular a Waelz process, for producing at least one non-ferrous metal or a compound thereof, wherein said metal is selected from the group consisting of arsenic (As), antimony (Sb), lead (Pb), cadmium (Cd), mercury (Hg), silver (Ag), tin (Sn), nickel (Ni), and zinc (Zn), and wherein at least one raw material is fed into a rotary kiln, wherein said at least one raw material comprises at least said metal, and wherein said raw material is heated to produce a volatized material, in which the non-ferrous metal or compound thereof is produced from the volatized material, in which process a magnesium-based additive, is additionally fed in the rotary kiln, which magnesium-based additive is heated together with said raw material to produce at least the volatized material and a solid product, and the magnesium-based additive is fed in the rotary kiln in an amount providing between 0.03 wt. % and 5.00 wt. % of magnesium oxide in the solid product, thereby counteracting ring formation in the rotary kiln.

The inventors have surprisingly found that by feeding a magnesium-based additive in the rotary kiln in an amount providing only between 0.03 wt. % and 5.00 wt. % of magnesium oxide in the solid product, ring formation in the rotary kiln is counteracted, and leads the ring to shed under its own weight, without external forces other than the forces engaged by the rotary kiln. This results in reducing the periodic shutdown operations, as illustrated in the working examples below. Furthermore, the inventors have surprisingly found that such rings are more susceptible to on-line cleaning such as thermal shedding or shotgun blasting. Without being bound to this theory, the inventors consider that the feeding of a magnesium-based additive which provides between 0.03 wt. % and 5.00 wt. % of magnesium oxide in the solid product might affect the ring's microscopic structure, which results, in addition to an increase the melting point of the fed materials within the rotary kiln, to weaken the cohesive strength of the kiln ring.

Furthermore, due to the presence of only small amounts of magnesium oxide in the solid product, the solid product is more suitable to be used for road-based constructions. In particular, in the Waelz process, the solid product, is also called Waelz Iron Product (WIP), and is found especially suitable to be used for road-based constructions.

In a preferred embodiment of the process according to the present invention, the magnesium-based additive is fed in the rotary kiln in an amount providing at most 4.50 wt. %, or at most 4.00 wt. %, or at most 3.50 wt. %, or at most 3.30 wt. %, or at most 3.10 wt. %, or at most 2.90 wt. %, or at most 2.70 wt. %, or at most 2.50 wt. %, or at most 2.30 wt. %, or at most 2.20 wt. %, or at most 2.00 wt. % or at most 1.80 wt. % of magnesium oxide in the solid product.

It is further understood that the lower limit of magnesium oxide present in the solid product should be sufficient to counteract formation of the kiln ring.

In a preferred embodiment of the process of the present invention, the magnesium-based additive is fed in the rotary kiln in an amount providing at least 0.10 wt. %, or at least 0.50 wt. %, or at least 1.00 wt. %, of magnesium oxide in the solid product.

Good results were found when the magnesium-based additive is fed in the rotary kiln in an amount providing between 1.00 wt. % and 2.50 wt. % of magnesium oxide in the solid product.

In order to obtain such provided amount in the solid product, it is required that the magnesium-based additive, as detailed above, is additionally fed in the rotary kiln with the raw material in an amount of below 9.5 wt. % relative to the total weight of the raw materials in order to keep the total amount of solid product as low as possible and also the total amount of impurities therein. This results in reducing the amount of waste and this solid product may be used and valorized in various applications without requiring the need of extensive purification processes.

Generally, all aspects of the present invention discussed herein in the context of a pyro-metallurgical process, in particular a Waelz process according to the first aspect of the invention apply to all other aspects, as defined above.

Thus, said pyro-metallurgical process, in particular a Waelz process, may have all the features of the pyro-metallurgical process, in particular a Waelz process, as described in the previous aspects, in particular in terms of the magnesium-based additive, the raw materials, the Waelz process, the solid product, and the use of the solid product produced as detailed above.

EXAMPLES

The invention will now be described in more details with examples, whose purpose is merely illustrative and not intended to limit the scope of the invention. In the examples, reference is made to the drawings.

General Procedure

A continuous Waelz process for producing zinc from Electric Arc Furnace dust (EAF dust) was carried out.

The EAF dust raw materials, was fed at a rate of 14.6 tons/hour Into a rotary kiln and heated at normal operating temperature for a Waelz kiln.

The EAF dust comprised zinc and compound thereof in an average amount of 20 wt. %, as expressed as zinc oxide wt. %, mixed with 16.5 wt. % of coal as reducing agent, relative to the total weight of said raw material.

The Waelz process was conducted until said process had to be stopped for the kiln to be cleaned out.

At the end of the process, the chemical and physical properties of the kiln range were investigated by SEM-EDS using a Quanta FEG250 environmental scanning electron microscope and EDAX energy dispersive spectroscopy apparatus.

Counter-Example 6 productions campaigns for the production of Zinc was carried out following the general procedure described herein-above.

The productions campaigns had an average duration of 38 days before the process has to be shut down for the kiln to be cleaned. These shut downs were initiated due to kiln ring formation restricting gas flow through the rotary kiln.

FIGS. 1 and 2.A to C shows SEM micrographs and elemental analysis of kiln rings samples. It was observed that the samples are highly crystalline.

Figure 2A:
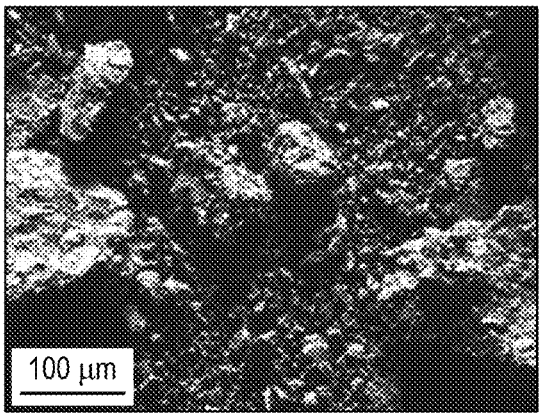
Figure 2B:
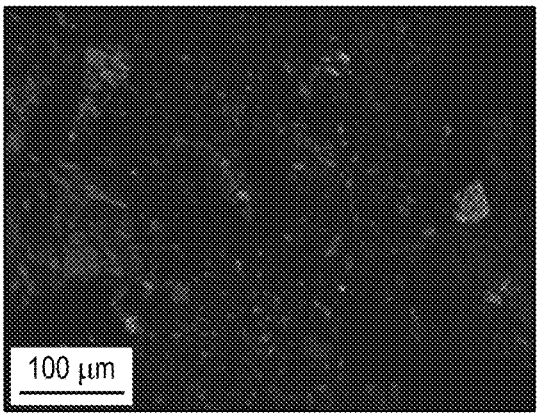
Figure 2C:
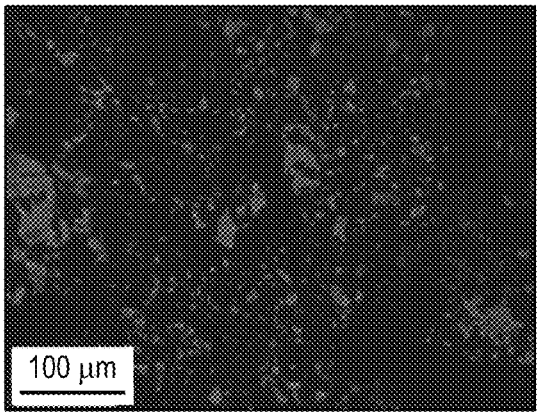
Figure 2D:
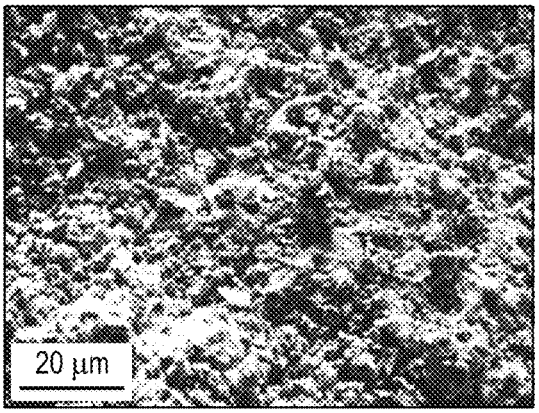
Figure 2E:
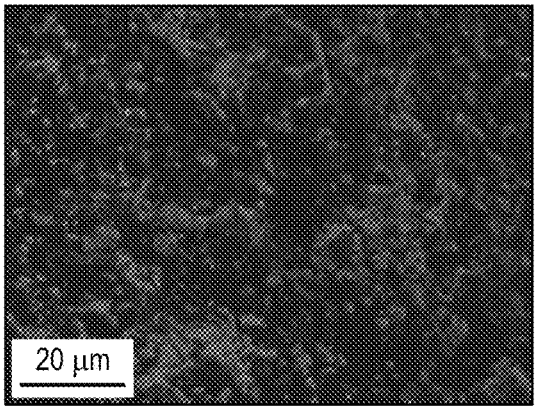
Figure 2F:
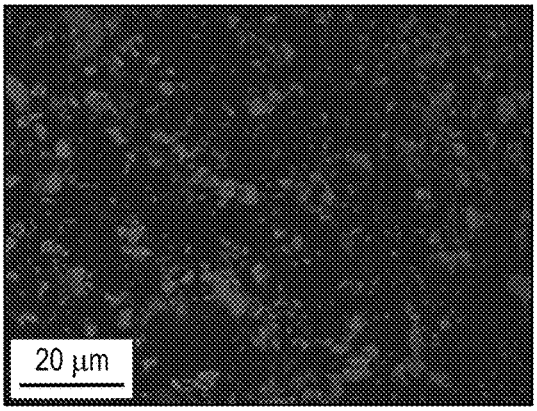

Furthermore, FIG. 2B to C shows that the distribution of magnesium and calcium, respectively, within the kiln ring samples are inhomogeneous throughout the sample.

FIG. 3.A shows a segregation of FeO, ZnO, $SiO_2$, MgO, and CaO into large domains.

Example 1

A production campaign according to the general procedure, was carried out with the feeding at a rate of 0.75 ton/hour of a dolomite comprising 38 wt. % of $MgCO_3$, thereby providing 4.9 wt. % of dolomite relative to the total weight of the EAF dust raw material, or 1.9 wt. % of magnesium carbonate into a rotary kiln.

The production campaign according to example 1 had a duration of 58 days before the process has to be shut down, due to the presence of a hot spot on the surface of the rotary kiln.

It was therefore demonstrated that the feeding of a magnesium-based additive according to the present invention led to a substantial increase duration of the production campaign. It was furthermore observed that, at the end of the duration campaign, the rotary kiln did not require a cleaning operation.

Furthermore, major shedding event of the kiln ring were clearly visible, on day 15, 21, and 42 of the production campaign.

It was therefore demonstrated that the feeding of a magnesium-based additive according to the present invention lead to the counteracting of the formation of kiln ring, by its shedding under its own weight, without involving any external forces.

FIGS. 2 D, E and F shows SEM micrographs and elemental analysis of kiln rings samples obtained from the production campaign according to Example 1.

The resulting kiln ring sample was shown to present a more amorphous character (FIG. 2.D) with an even distribution of magnesium and calcium within said sample (FIG. 2. E, F).

Furthermore, FIG. 3.B shows a distribution of FeO, ZnO, $SiO_2$, MgO, and CaO into small domains within the kiln rings.

Figure 3A:
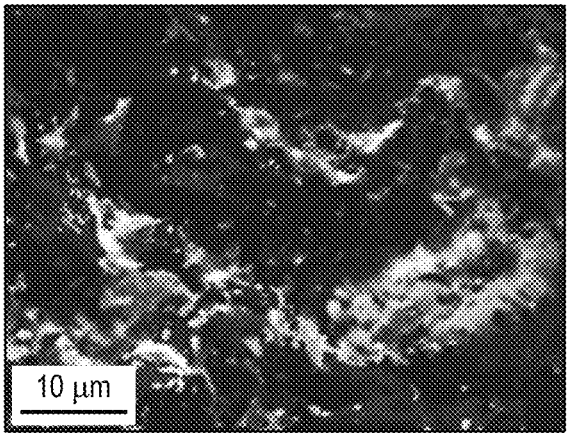
FIG. 3.A is elemental map of a kiln ring sample according to a counter-example, in which the presence of FeO, ZnO, $SiO_2$, MgO, and CaO have been mapped using SEM-EDS technique.
Figure 3B:
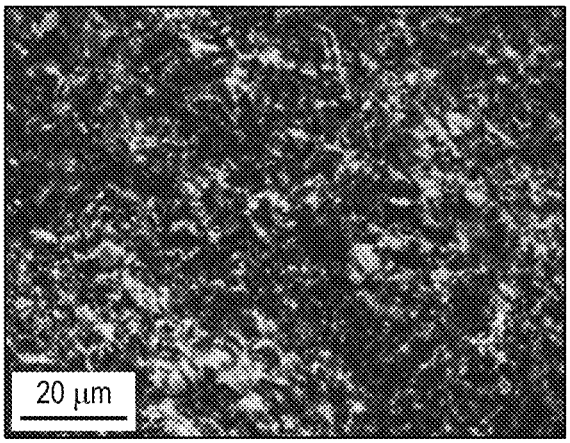

Table I below contains elemental analysis data taken from the ring sample of FIG. 3A. Table II is a similar set of elemental analysis data taken from the kiln ring shown in FIG. 3B.

TABLE I

| Element | Weight % | Atomic % |
|---|---|---|
| O K | 30.44 | 49.87 |
| NaK | 7.01 | 7.99 |
| MgK | 1.85 | 1.99 |
| AlK | 0.49 | .47 |
| SiK | 5.65 | 5.27 |
| CaK | 20.30 | 13.27 |
| MnK | 2.07 | 0.99 |
| FeK | 23.65 | 11.10 |

TABLE II

| Element | Weight % | Atomic % |
|---|---|---|
| O K | 26.95 | 47.96 |
| NaK | 9.68 | 11.99 |
| MgK | 4.67 | 5.47 |
| AlK | 1.78 | 1.87 |
| SiK | 2.97 | 3.01 |
| CaK | 10.70 | 7.60 |
| MnK | 3.72 | 1.93 |
| FeK | 39.52 | 20.15 |

Without being bound to this theory, the inventors consider that an amorphous microscopic structure of the kiln ring weakens the cohesive forces of the kiln rings, thereby leading to kiln ring shedding. Furthermore, the inventors consider that the even distribution of magnesium and calcium within the kiln ring, along with smaller domains. The inventors further consider that it weakens the cohesive forces of the kiln rings and is also responsible for the shedding of the kiln ring during the production campaign.

The invention claimed is:

1. A pyro-metallurgical process for producing at least one non-ferrous metal or a compound thereof; wherein said metal is selected from the group consisting of arsenic (As), antimony (Sb), lead (Pb), cadmium (Cd), mercury (Hg), silver (Ag), tin (Sn), nickel (Ni), and zinc (Zn), and wherein at least one raw material is fed into a rotary kiln, wherein said at least one raw material comprises at least said metal, and wherein said raw material is heated to produce a volatized material, in Which the non-ferrous metal or compound thereof is produced from the volatized material, in which process a magnesium-based additive, is additionally fed in the rotary kiln in an amount of between 0.5 wt. % and 9.5 wt. % relative to the total weight of said raw materials, which magnesium-based additive is heated together with said raw material to produce at least the volatized material and a solid product, thereby counteracting ring formation in the rotary kiln; and wherein the additional feeding of the magnesium-based additive provide between 0.03 wt. % and 5.00 wt % of magnesium oxide in the solid product.

2. The process according to claim 1, wherein the magnesium-based additive is additionally fed in the rotary kiln in an amount of between 3.0 wt. and 7.5 wt. % relative to the total weight of said raw materials.

3. The process according to claim 1, wherein the magnesium-based additive is a compound comprising at least one magnesium salt or a composition comprising at least one magnesium salt, or a mixture thereof.

4. The process according to claim 1, wherein the magnesium-based additive comprises at least one magnesium salt selected from the group consisting of magnesium carbonate, magnesium oxide, and magnesium hydroxide.

5. The process according to claim 1, wherein the magnesium-based additive is a compound comprising at least one magnesium salt and at least one calcium salt, wherein the total amount of the at least one magnesium salt and the at least one calcium salt is more than 80.0 wt. % relative to the total weight of the composition, and wherein the magnesium salt content varies from 10.0 wt, % to 90.0 wt. %, relative to the total weight of the magnesium salt and the calcium salt.

6. The process according to claim 5, wherein the magnesium-based additive is a dolomitic limestone comprising $MgCO_3$ and $CaCO_3$, and wherein the total content of $MgCO_3$ and $CaCO_3$ is more than 95.0 wt. % relative to the total weight of the dolomitic limestone, and wherein the $MgCO_3$ content ranges from 20.0 wt. % to 45.0 wt. %, relative to the total weight of $MgCO_3$ and $CaCO_3$.

7. The process according to claim 6, wherein the magnesium-basal additive is a dolomite.

8. The process according to claim 1, wherein the magnesium-based additive is a composition comprising at least one magnesium salt and at least one calcium salt, wherein the total amount of the at least one magnesium salt and the at least one calcium salt is more than 80.0 wt, % relative to the total weight of the composition, and wherein the magnesium salt content varies from 10.0 wt. % to 90.0 wt, % relative to the total weight of the magnesium salt and the calcium salt.

9. The process according to claim 1, wherein the raw material is heated to produce the volatized material at a temperature of at least 900° C.

10. The process according to claim 1, wherein at least one mincing agent is additionally fed in the rotary kiln.

11. The process according to claim 10, wherein the at least one reducing agent is a carbonaceous material selected from the group consisting of coal, coke and anthracite.

12. The process according to claim 11, wherein the reducing agent is fed into the rotary kiln in an amount of between 5.0 and 40.0 wt. % relative to the total weight of said at least one raw material.

13. The process according to claim 12, wherein the raw material is an electric arc furnace (EAF) dust comprising zinc and compounds thereof in an amount between 7.0 wt. % and 40.0 wt. % as expressed in zinc oxide wt. %, relative to the weight of the EAF dust.

14. The process according to claim 1, wherein the pyrometallurgical process is a Waelz process for the production of non-ferrous metal or a compound thereof, chosen from the group consisting of zinc and lead and cadmium.

* * * * *